US006003200A

United States Patent [19]

Potts et al.

[11] Patent Number: 6,003,200

[45] Date of Patent: Dec. 21, 1999

[54] POWERHEAD HOUSING ASSEMBLY FOR VACUUM CLEANER

[75] Inventors: Aaron J. Potts, Carrollton; Jerome G. Kitska, Akron; David B. Finley, Alliance, all of Ohio

[73] Assignee: Overhead Door Corporation, Dallas, Tex.

[21] Appl. No.: 08/970,895

[22] Filed: Nov. 14, 1997

[51] Int. Cl.[6] ..... A47L 11/00

[52] U.S. Cl. ..... 15/413; 15/327.2

[58] Field of Search ..... 15/413, 326, 327.1, 15/327.2

[56] References Cited

U.S. PATENT DOCUMENTS

| | | | |
|---|---|---|---|
| 2,884,185 | 4/1959 | Dolan | 15/413 |
| 3,780,397 | 12/1973 | Harbeck et al. | 15/413 |
| 3,815,172 | 6/1974 | Fromknect et al. | 15/413 |
| 4,120,616 | 10/1978 | Dwyer et al. . | |
| 4,195,969 | 4/1980 | Whitney . | |
| 4,213,224 | 7/1980 | Miller . | |
| 4,280,245 | 7/1981 | Hiester . | |
| 4,330,899 | 5/1982 | Miller et al. . | |
| 4,356,591 | 11/1982 | Lude . | |
| 4,435,877 | 3/1984 | Berfield . | |
| 4,538,971 | 9/1985 | Miller et al. . | |
| 4,665,581 | 5/1987 | Oberdorfer . | |
| 5,068,555 | 11/1991 | Oberdorfer-Bogel . | |
| 5,353,469 | 10/1994 | Fellhauer . | |

*Primary Examiner*—Robert J. Warden, Sr.
*Assistant Examiner*—Kaj K. Olsen
*Attorney, Agent, or Firm*—Akin, Gump, Strauss, Hauer & Feld

[57] ABSTRACT

Vacuum cleaning apparatus, particularly adapted for wet/dry cleaning operations includes a powerhead housing assembly formed by an impeller housing for supporting an electric motor which drives a working air impeller and a motor cooling air fan and a cover member removably secured to the impeller housing. The impeller housing and the cover member define flow passages and chambers for diffusing and expanding working air flow to reduce noise emissions therefrom and for directing motor cooling air through the housing assembly without mixing with working air flow and while minimizing the ingestion of working air into the motor cooling air flowpath. An alternate embodiment of the housing assembly includes separable, opposed impeller housing members and a shroud member, all secured together by common fasteners and cooperating to form the working air diffusing and expansion chambers together with the cooling air flow passages. Inlet and discharge ports in the air positioned to provide for minimizing ingestion of exhausted working air into cooling air intake ports.

27 Claims, 11 Drawing Sheets

POWERHEAD HOUSING ASSEMBLY FOR VACUUM CLEANER

FIELD OF THE INVENTION

The present invention pertains to a housing assembly for a vacuum cleaner for supporting the vacuum working air motor and impeller and providing improved flowpaths for the vacuum working air and motor cooling air to reduce acoustic emissions and flow resistance.

BACKGROUND

In the art of portable vacuum cleaning apparatus, particularly of the so-called wet/dry type, various efforts have been undertaken to provide a powerhead housing construction which provides suitable separate air flowpaths for the exhaust flow of the vacuum cleaner working air and for routing cooling air to and away from the electric motor which drives the working air impeller. Important considerations in the development of portable vacuum cleaners, particularly of the wet/dry type, are the provision of housing assemblies which are lightweight, and easily fabricated with a reduced number of working parts, but which also provide for suitably supporting the electric motor which drives the impeller for the vacuum cleaner working air. In addition to the above-mentioned requirements and desiderata, separate flowpaths for the working air exhaust flow and motor cooling air are required through the housing and wherein, in particular, the cooling air inlet is not located in such a position as to ingest working air exhaust flow. A further requirement which must be met is to minimize flow resistance for the working air and cooling air through the housing and, importantly, reduce audible acoustic emissions from the motor, the working air impeller, the motor cooling fan and the air flow generated by these mechanisms. Several efforts have been undertaken in the prior art to meet the desiderata and requirements mentioned herein. However, prior art efforts have, for the most part, resulted in relatively complex housing assemblies or, in the interest of reducing the complexity of the housing construction, certain of the desiderata mentioned herein have been sacrificed.

SUMMARY OF THE INVENTION

The present invention provides improved vacuum cleaning apparatus having a powerhead housing constructed to provide for efficient and quiet flow of working air and motor cooling air through the housing for exhaust to atmosphere adjacent the housing. The powerhead housing constructions of the invention also require a minimum number of parts, which may be easily fabricated by conventional mass production methods and materials, and which parts may be easily assembled and disassembled to repair and replace portions of the powerheads, if required.

In accordance with one aspect of the present invention, a powerhead housing assembly for a vacuum cleaning apparatus is provided which comprises a molded impeller housing having a peripheral flange and latch means for securing the impeller housing to a tank for receiving debris collected by the vacuum cleaning apparatus, the impeller housing also including a portion for supporting a motor assembly therein. A removable cover is adapted to be disposed over the impeller housing and to provide, in combination with the impeller housing, improved air flowpaths for working air and motor cooling air. The impeller housing is also provided with a removable baffle part which cooperates with a baffle wall formed in the cover to prevent commingling of working air exhaust flow with motor cooling air.

In accordance with another aspect of the invention a powerhead housing assembly is provided with a cover which includes a separable cooling air duct part mounted on the cover and operable to provide a flowpath for motor cooling air through a discharge passage formed by the cover and the removable duct part. Motor cooling air is ingested through a gap between the cover and the impeller housing and is discharged at a location away from the point of cooling air ingestion. The combination of parts described may be easily fabricated, and easily assembled and disassembled to provide an embodiment of a powerhead with minimal parts but with improved air flow and noise suppression characteristics.

In accordance with another aspect of the present invention, an embodiment of a vacuum cleaning apparatus powerhead is provided which also provides for reduced acoustic emissions, minimum air flow restriction or back pressure and which utilizes a minimum number of parts which may be fabricated by mass production molding techniques and may be easily assembled and disassembled to provide support for a drive motor for the vacuum cleaner impeller and to provide the above-mentioned air flowpaths. Cooling air inlet ports are located on the powerhead housing in a position remote from the working air and cooling air exhaust ports to minimize reingestion of heated cooling air or working air. Air inlet and discharge ports are arranged to minimize inadvertent or unwanted ingestion of foreign objects which may block air flow or damage working parts, such as the motor rotor, cooling air fan or working air impeller.

Still further, the present invention provides improved housing assembly constructions for powerheads for vacuum cleaning apparatus which are aesthetically pleasing, may be easily connected to or disconnected from a vacuum cleaner tank part and are of lightweight but durable construction.

Those skilled in the art will further appreciate the above-mentioned advantages and superior features of the invention together with other important aspects thereof upon reading the detailed description which follows in conjunction with the drawing.

DESCRIPTION OF THE PREFERRED EMBODIMENTS

Figure 1:
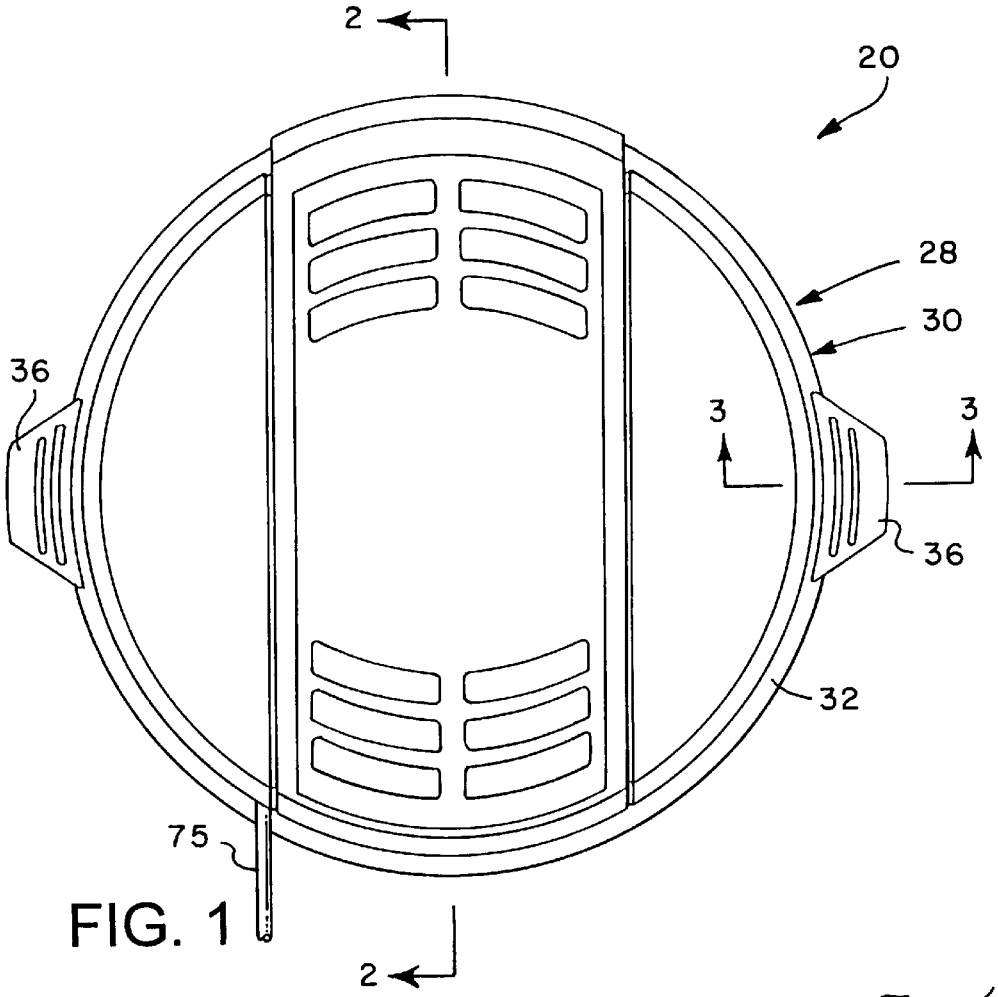
FIG. 1 is a top plan view of a vacuum cleaning apparatus having a powerhead housing assembly in accordance with the present invention.

In the description which follows like parts are marked through the specification and drawing with the same reference numerals, respectively. The drawing figures are not necessarily to scale and certain elements may be shown exaggerated in scale or in somewhat generalized form in the interest of clarity and conciseness.

Figure 2:
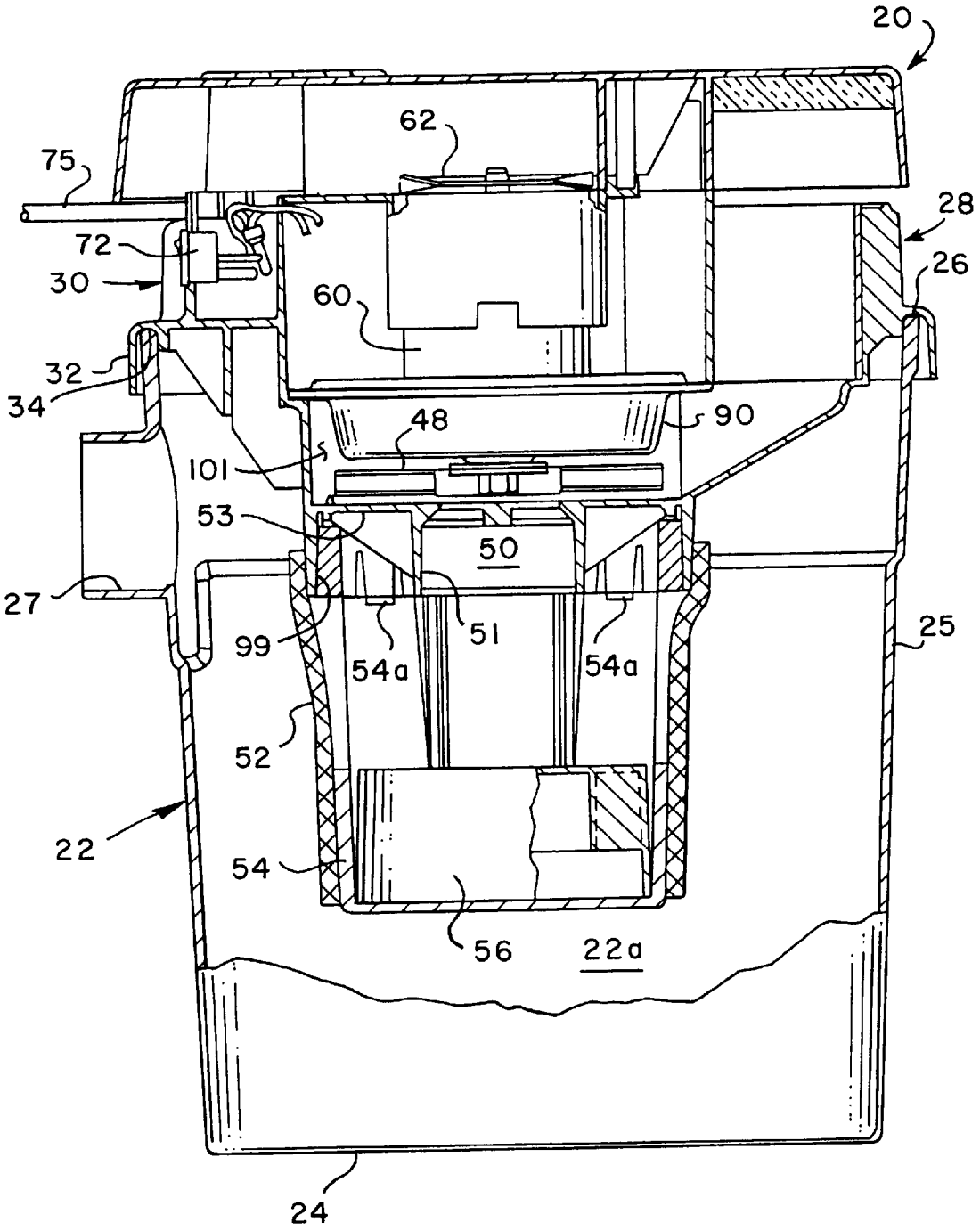
FIG. 2 is a section view taken generally from the line 2—2 of FIG. 1.

Referring now to FIGS. 1 and 2, there is illustrated a preferred embodiment of the invention comprising a vacuum cleaning apparatus 20 which may be of a type particularly adapted to remove debris in both liquid and solid form from a work surface, not shown. The apparatus 20 includes a generally cylindrical debris collection tank 22, FIG. 2, having a bottom wall 24 and a cylindrical sidewall 25 delimited by a peripheral rim 26 on which is mounted a removable powerhead assembly 28. The powerhead assembly 28 includes a generally cylindrical impeller housing 30 having a peripheral depending skirt portion 32 forming an annular groove 34, FIG. 2, for receiving the rim 26 of the tank 22.

Figure 3:
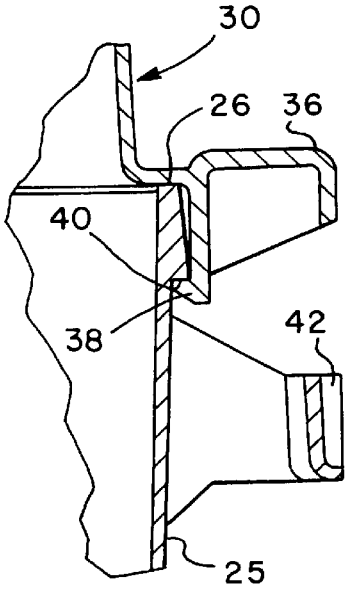
FIG. 3 is a detail section view taken from line 3—3 of FIG. 1 illustrating a latch arrangement between the powerhead shown in FIGS. 1 and 2 and a debris collection tank.

As shown in FIGS. 1 and 3, the housing 30 includes opposed latch members 36 which are cooperable with the tank 22 to releasably retain the powerhead 28 supported on the tank. Referring briefly to FIG. 3, by way of example, each of the latch members 36 includes an integral latch jaw 38 cooperable with a ledge 40 formed on the rim 26 at opposed points thereon coinciding with the location of the latches 36 for releasably retaining the powerhead 28 on the tank 22. As also shown by way of example in FIG. 3, the tank 22 may have opposed handles 42, one shown, formed integral with the tank sidewall 25 adjacent the latch jaws 38. The housing 30 is preferably formed of a suitable elastically deflectable material such as molded plastic to enable the latches 36 to be deflected into and out of their working positions to retain the powerhead 28 on the tank 22.

Referring again to FIG. 2, the powerhead 28 includes a motor driven, centrifugal, working air impeller 48 mounted in the housing 30 in a manner to be explained in further detail herein and adjacent a working air inlet passage 50 formed by the housing 30 and disposed downstream of a generally cylindrical porous media filter element 52. The filter element 52 is mounted on a generally cylindrical cage member 54 which supports a generally cylindrical inverted cup shaped float valve closure member 56 which is responsive to accumulation of liquid in the tank 22 to close over the passage 50 to prevent ingestion of liquid into the impeller 48. Passage 50 is defined by a cylindrical, downwardly projecting wall 51 which is integral with a transverse bottom wall 53 of housing 30. Working air ports 53*a* admit flow to impeller 48, see FIG. 4 also.

An AC electric induction motor 60 is suitably mounted in the housing 30 for rotatably driving the impeller 48 and for rotatably driving an axial flow motor cooling air fan 62 to induce the flow of cooling air over the motor 60 during operation thereof. Working air laden with debris is drawn into a chamber 22*a* in the tank 22 through a suitable inlet port 27, FIG. 2, which may include means, not shown, for connecting the tank to a hose or other suitable conduit used in the vacuuming process. Liquid and solid debris is separated from working air in the tank 22 whereby working air flows from chamber 22*a* through the filter media 52, the port 50 and is discharged from the apparatus 20 in a manner to be described in further detail herein.

Figure 4:
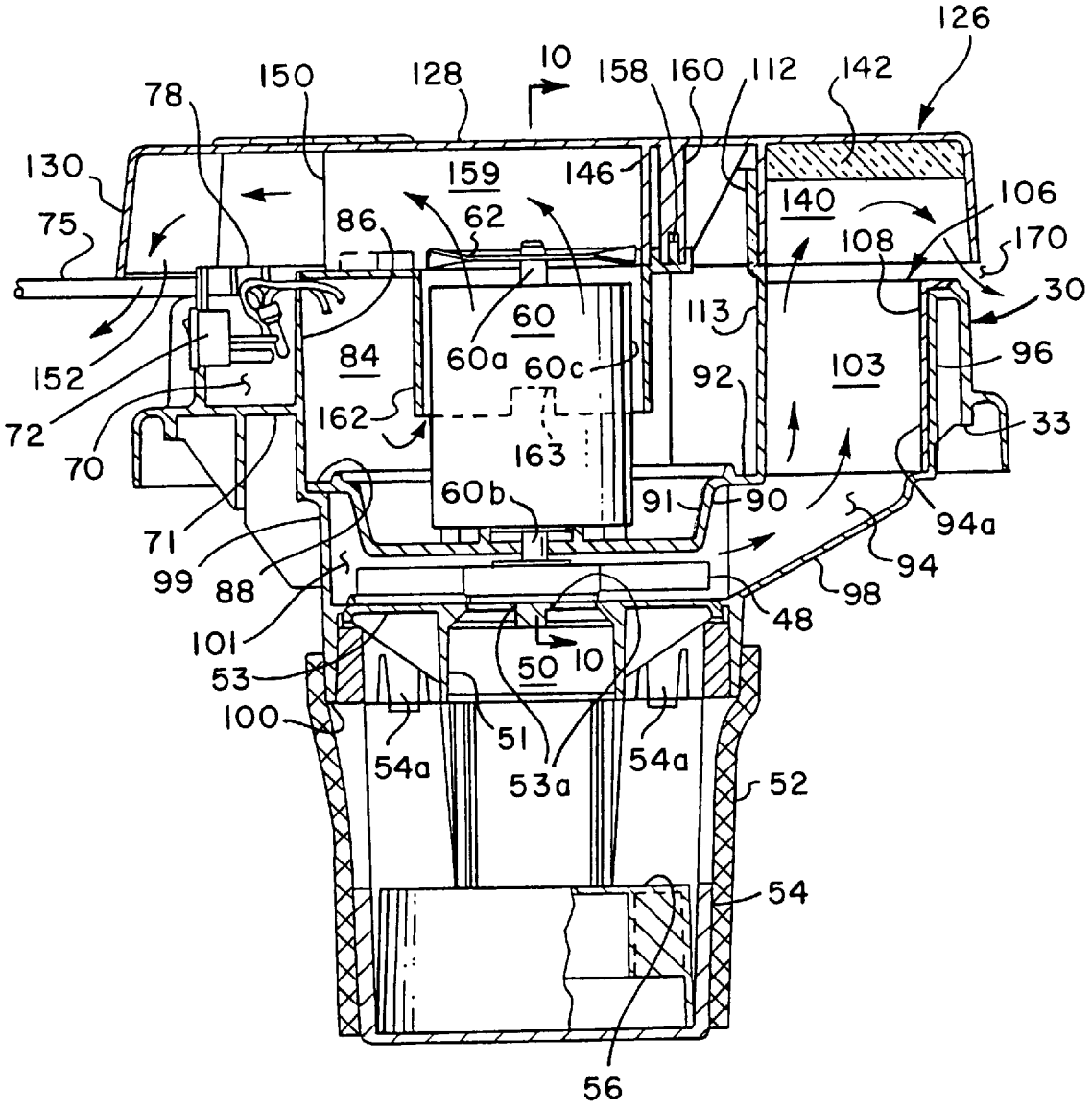
FIG. 4 is a section view, taken generally on the same line as the view of FIG. 2 of the powerhead housing assembly for the apparatus shown in FIGS. 1 and 2.
Figure 5:
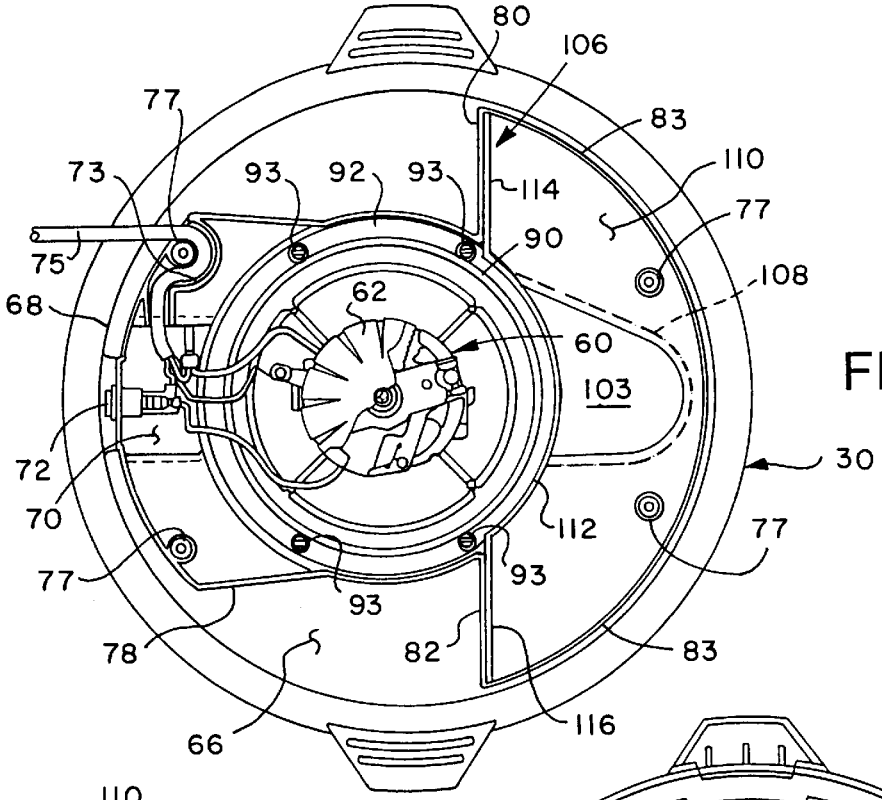
FIG. 5 is a top plan view of the impeller housing and motor assembly with the cover removed.
Figure 7A:
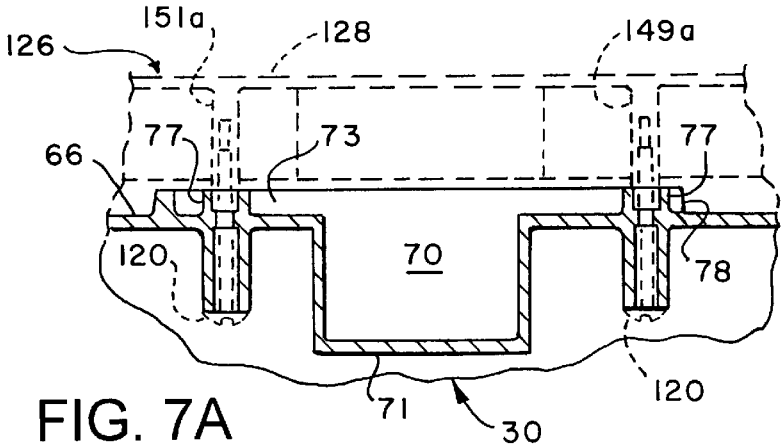
FIG. 7A is a detail section view taken along the line 7A—7A of FIG. 7.
Figure 7:
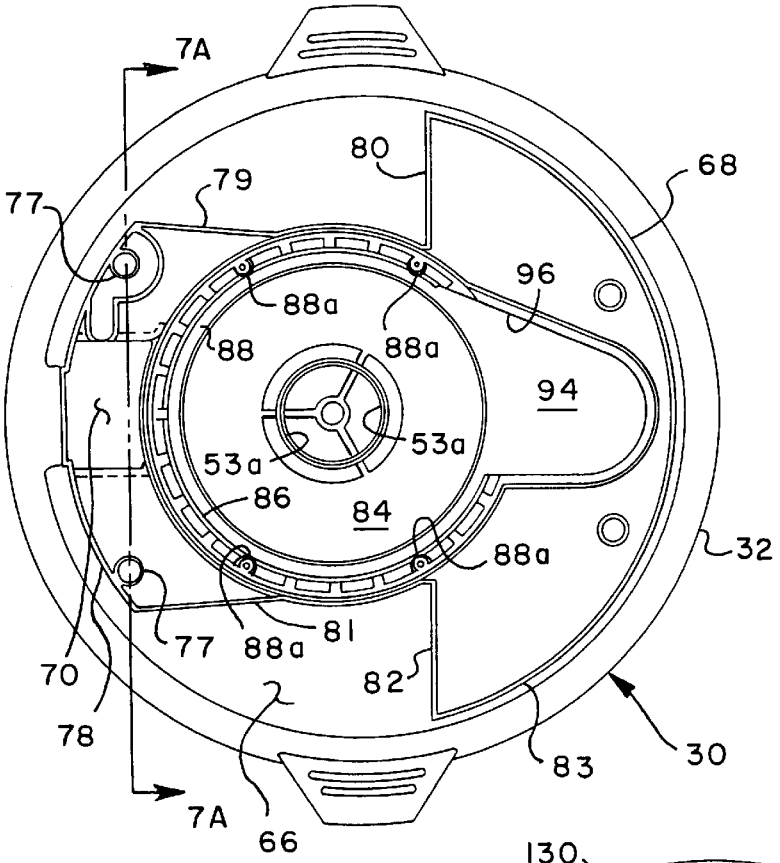
FIG. 7 is a top plan view of the impeller housing only for the housing assembly shown in FIGS. 1 through 4.
Figure 10:
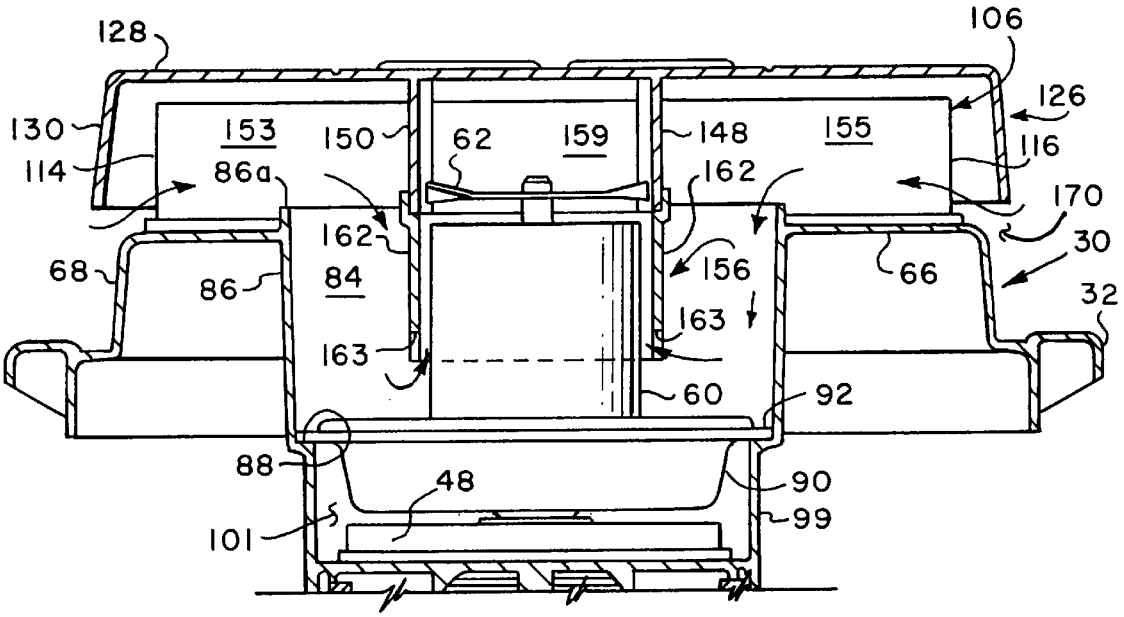
FIG. 10 is a section view taken generally from the line 10—10 of FIG. 4.

Referring now to FIGS. 4 through 7 and 10, the housing 30 is further characterized by a transverse top wall 66, see FIGS. 7 and 10, which is connected to the rim 32 by a depending, peripheral sidewall 68. A first recess 70, FIGS. 4, 7 and 7A, intersects the wall 66 for receiving a motor actuating switch 72, FIG. 4. Recess 70 is delimited by a transverse bottom wall 71. A somewhat serpentine recess 73, FIGS. 5 and 7A, is provided for receiving a power cord 75, FIG. 5, and to provide a strain relief structure for said power cord. Recess 73 is formed in part by one of plural spaced apart fastener receiving bosses 77 projecting from wall 66 in opposite directions, see FIG. 7A.

A vertically extending ledge 78, FIGS. 4, 7, 7A and 10, projects upwardly from the wall 66 and includes opposed portions 79 and 81 which are connected to transverse portions 80 and 82 and a partial arcuate portion 83, all shown in FIG. 7. A generally central cylindrical space 84 is formed in housing 30, FIG. 7, and is delimited by a peripheral sidewall 86 having an upper peripheral edge 86*a* and a transverse shoulder 88, spaced therefrom and provided with spaced apart fastener receiving bosses 88*a*, FIG. 7. The shoulder 88 is adapted to support a cylindrical, somewhat pan-shaped base 90 for motor 60, see FIGS. 4 and 7. The base 90 includes a circumferential flange portion 92 which is adapted to be supported in the housing 30 by the shoulder 88 and secured thereto by spaced apart fasteners 93, FIG. 5, which project into suitable bores formed in bosses 88*a*.

A generally radially extending passage 94, FIGS. 4 and 7, is delimited by a sidewall 96 and a sloping bottom wall 98. Sidewall 96 and bottom wall 98 intersect a peripheral, generally cylindrical sidewall 99 which depends from the shoulder 88 FIGS. 4 and 10, to a distal end portion 100, for receiving and supporting the cage 54. Spaced apart radial reinforcing webs 89, FIG. 6, extend between walls 86, 99 and an inner rim portion 33. The cage 54 is releasably secured to the sidewall 99 by elastically deflectable latch members 54*a* which are registrable with cooperating spaced apart slots, not shown, formed in the sidewall.

As shown in FIG. 4, the depending sidewall 99, together with the base 90 and bottom wall 53, forms an annular discharge plenum chamber 101 for working air being discharged from the periphery of the impeller 48 in a conventional manner. Air flows from the chamber 101 into the passage 94 and then through a passage 103, FIG. 4, substantially vertically out of the housing 30.

Figure 5A:
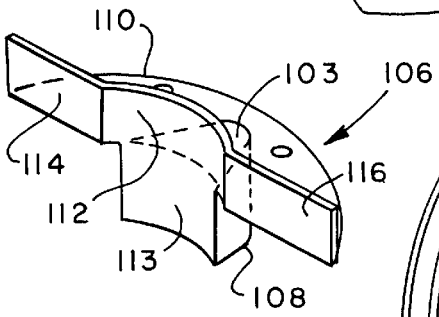
FIG. 5A is a perspective view of an air baffle insert for the impeller housing.

In order to block the flow of working air exiting the passage 94 from entering the chamber or space 84, a separate baffle insert part 106, FIGS. 4, 5 and 5A is adapted to be removably supported on the housing 30 and is characterized by a depending wall portion 108 which is dimensioned to fit within the passage 94*a* substantially contiguous with the wall 96 and defining passage 103. A generally, transverse arcuate flange portion 110 of the baffle 106 is dimensioned to fit within a shallow recess defined by the upstanding ledge portions 80, 82 and 83 formed on the housing 30. Still further, an arcuate baffle wall portion 112 projects upwardly from the flange 110 and is contiguous with generally transverse opposed baffle wall portions 114 and 116. Wall portion 112 includes a depending part 113 contiguous with wall 108 and forming a closure for the chamber 84 to separate chamber 84 from passage 103 while providing for chambers 101 and passage 94 to be in communication with passage 103. The pan-shaped base 90 includes a depending cylindrical sidewall 91 which is of a smaller diameter than the diameter of sidewall 99 to provide adequate volume of chamber 101 around the periphery of the base 90.

The motor 60 is suitably mounted on the base 90 by fastener means, not shown, and includes a rotor having opposed shaft portions 60*a* and 60*b*, FIG. 4, which are suitably secured to the cooling air fan 62 and the working air impeller 48, respectively. Impeller 48 is a closed type having an inlet opening adjacent the passage 50 and ports 53*a*. The baffle part 106 is retained at least in part, in its working position by the depending wall 108 which is nested within the confines of wall 96 and by two of the bosses 77, as shown in FIG. 5, which project through suitable openings formed in the flange portion 110. The baffle part 106 is also retained in its working position by a removable cover member 126, FIG. 4, secured to the housing 30, which cover member forms a working air discharge plenum and diffusing chamber to be described in further detail herein, together with passage means for conducting motor cooling air to and from the motor 60.

Figure 8A:
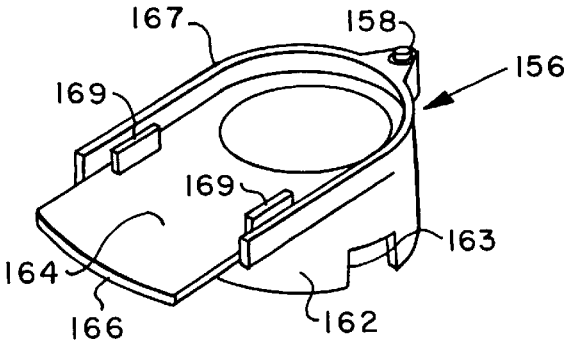
FIG. 8A is a perspective view of a motor cooling air duct part.
Figure 8:
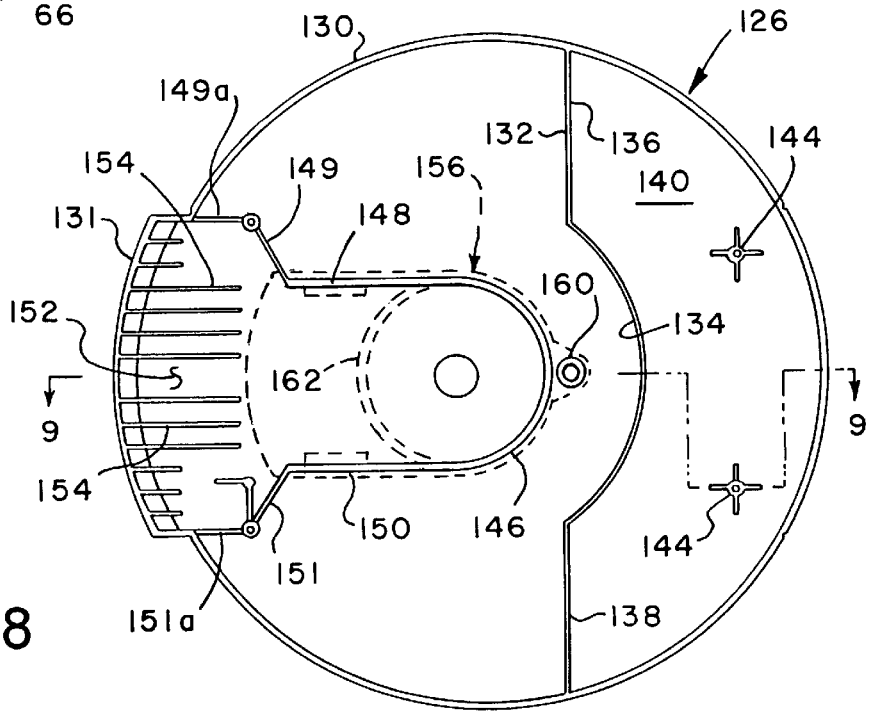
FIG. 8 is a bottom plan view of the cover for the embodiment of the apparatus shown in FIGS. 1 through 4.
Figure 9:
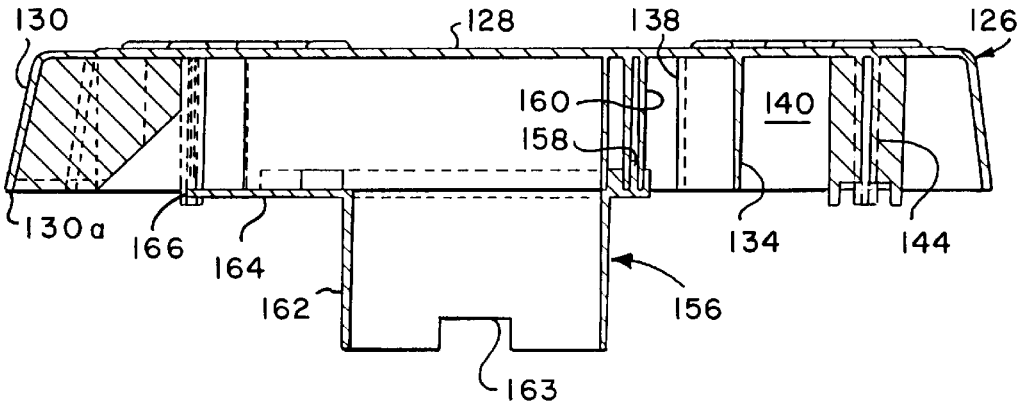
FIG. 9 is a section view taken generally along the line 9—9 of FIG. 8 with the duct part of FIG. 8A in its working position.

Referring now to FIGS. 4 and 8 through 10, in particular, the cover 126 is characterized as a generally cylindrical, shallow, inverted pan-shaped member having a horizontal top wall 128 and a peripheral depending skirt 130. As shown in FIGS. 8 and 9, the cover 126 also includes a depending intermediate baffle wall 132 having an arcuate portion 134 coinciding substantially with the arcuate wall 112, 113 of the baffle part 106, and opposed generally planar wall parts 136 and 138 which, when the cover 126 is mounted on the housing 30, become coextensive and substantially contiguous with the wall portions 114 and 116 of the baffle part 106.

A chamber 140, delimited by the top wall 128, the peripheral skirt 130, and the baffle wall 132 is partially filled with a sound absorbing pad 142, preferably formed of open cell plastic foam. The pad 142 is suitably retained in the chamber 140 by integrally formed somewhat cross-shaped pad retainer and fastener receiving bosses 144, FIGS. 8 and 9, depending from top wall 128. An arcuate, depending wall portion 146 also projects from the top wall 128 just off center from the central axis of peripheral skirt 130 and is contiguous with opposed laterally projecting planar sidewall portions 148 and 150, FIG. 8, projecting away from the baffle 132 toward a cooling air discharge port 152. Port 152 is defined by an offset portion 131 of peripheral skirt 130 and a plurality of spaced apart, generally parallel flow diffuser vanes 154. Wall portions 148 and 150 include laterally spaced apart diverging wall parts 149 and 151 and 149*a*, 151*a* which extend to the offset peripheral skirt portion 131.

A separable motor cooling air duct part 156, FIGS. 4, 8, 8A and 9, is adapted to be secured to the cover 126 by a force fitted integral pin portion 158 which projects into a bore formed in a boss 160, FIG. 9. The cooling air duct 156 includes a generally cylindrical depending duct portion 162 and a laterally projecting planar wall part 164 which is operable to extend between the wall parts 148 and 150 and is delimited by a distal transverse edge 166, FIGS. 8 and 9, which further delimits part of the cooling air discharge port 152. The duct portion 162 also includes opposed cooling air inlet ports 163 formed in the lower distal edge thereof, as shown in FIGS. 9 and 10. Duct portion 162 is slightly larger in diameter than the outside diameter of the stator section 60*c* of the motor 60, as illustrated in FIG. 4. An upwardly projecting flange 167, FIG. 8A, is cooperable with spaced apart tabs 169 to aid in securing the duct 156 to the cover 126. Flange 167 essentially encircles wall portions 146, 148, 150.

Figure 6:
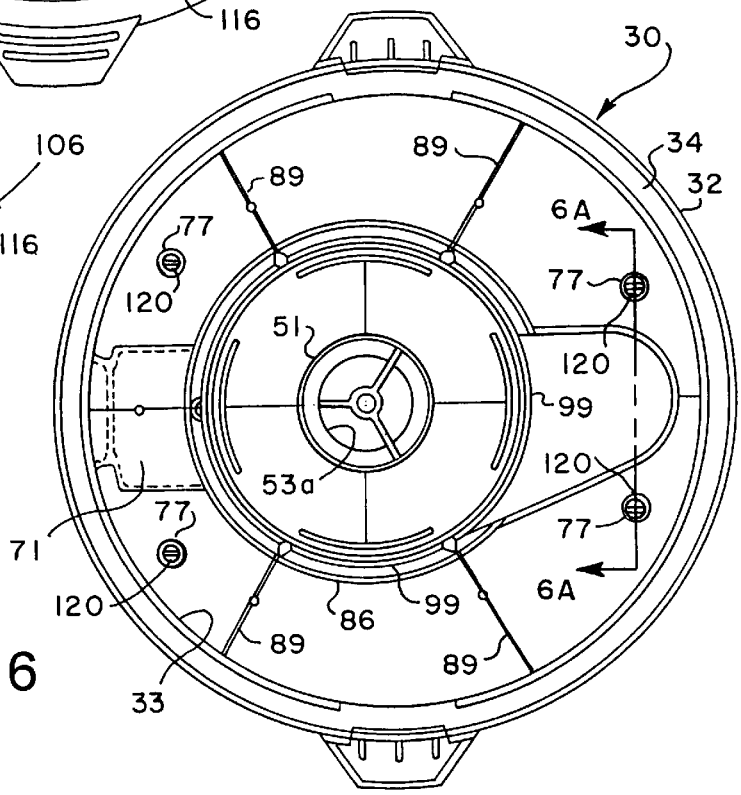
FIG. 6 is a bottom plan view of the impeller housing of the apparatus shown in FIGS. 1 through 4 with a float valve and support cage removed.
Figure 6A:
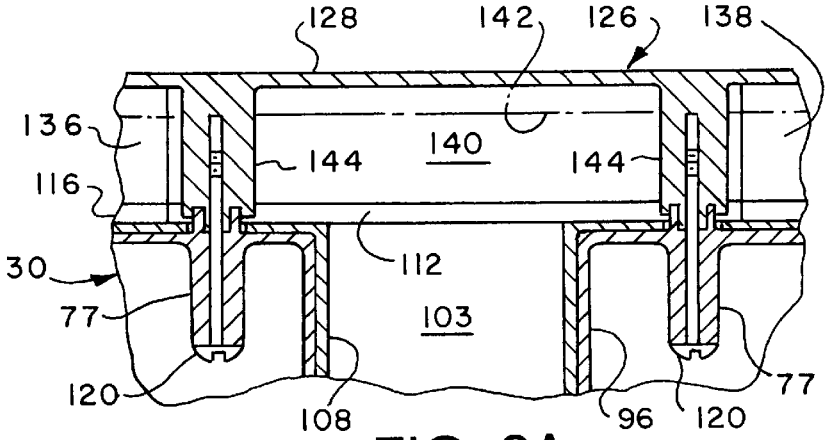
FIG. 6A is a detail section view taken from line 6A—6A of FIG. 6.

Referring to FIGS. 6A and 7A, the fastener receiving bosses 149 and 151, together with the bosses 144, are operable to receive fasteners 120 to secure the cover 126 to the housing 30. The fasteners 120 are inserted into the bosses 77 from the bottom side of the transverse wall 66 and project into the aforedescribed bosses in the cover 126. FIGS. 6A and 7A also illustrate how bosses 144, 149*a* and 151*a* register and partially interlock with bosses 77 on housing 30 and receive fasteners 120, respectively.

When the cover 126, together with the motor cooling air duct 156, is assembled to the housing 30 a unique, compact arrangement of flowpaths is provided for working air and motor cooling air, respectively, which flowpaths are separated from each other and substantially eliminate commingling of exhausted working air from cooling air flow to the motor 60. As shown in FIGS. 4 and 10, a peripheral gap 170 is provided between the lower peripheral edge 130*a* of the skirt 130 and the housing 30, portions of which, around the periphery of the cover 126, provide both a working air discharge flow area and a cooling air inlet flow area. These flow passages or areas are substantially separate from each other thanks to the wall portions 112, 114 and 116 of the baffle 106 and the baffle wall 132 of the cover 126 when the cover is assembled to the housing 30.

In operation, the centrifugal impeller 48 draws working air into the housing 30 through the inlet passage 50 and ports 53*a* whereupon working air is expelled from the impeller 48 at its periphery and into the annular chamber 101 for flow through passages 94 and 103 into the chamber 140 which is disposed directly above the housing 30 at the opening therein delimited by the wall 108. The velocity of working air discharged from chamber 101 is substantially reduced as it flows into the chamber 140 is redirected and then exits the chamber 140 through part of the gap 170 between the cover 126 and the housing 30. Moreover, line of sight communication between the passage 103 and the area surrounding the powerhead 28 is prevented by the location of the passage 103 relative to the cover 126. Audible noise generated by the working air flow leaving the passage 103 is also substantially suppressed by the sound suppressing or absorbing layer 142.

At the same time as working air flow is being conducted through the powerhead 28 in the manner described hereinabove motor cooling air is being inducted through opposed parts of the gap 170 between the cover 126 and the housing 30 and through passages 153 and 155, FIG. 10, formed between the wall portions 149, 151 and the barrier formed by baffles 132 and 106, respectively. Cooling air flows over edge 86*a* and into chamber 84 between the sidewall 86 of the housing 30 and the duct portion 162. Motor cooling air then flows through ports 163 and the clearance space between duct portion 162 and motor 60. Cooling air is drawn through the motor 60 in clearance spaces between the rotor and stator from one end of the motor to the other, as well as over the exterior of the motor and cooling air is discharged into a chamber 159, FIGS. 4 and 10, delimited by walls 128, 146, 148, 150, and 164, which chamber is in communication with the discharge port 152. Accordingly, motor cooling air is discharged from the powerhead 28 substantially diametrically opposite the discharge area for working air flow and is also separated from cooling air flow to the motor 60 by the baffle walls 149 and 151. Moreover, the downwardly directed port 152 also minimizes the emission of perceived audible noise from motor cooling air flow. Still further, the provision of the cooling air duct portion 162 nested within the outer wall 86, 113 also minimizes the emission of motor generated noise from the power head 28.

The fabrication and assembly of the powerhead 28 is believed to be readily understandable to one of ordinary skill in the art based on the foregoing description. However, briefly, the housing 30, cage 54, base 90, baffle 106, cover 126 and shroud 156 may be formed of injection molded impact resilient plastic. The motor 60 is assembled to the base 90 and installed in the housing 30 with the fasteners 93 prior to assembly of the housing to cover 126. Upon assembly of the motor 60, including its base 90, to the housing 30 the switch 72 is installed in its working position, together with the wiring for the motor, which may be pre-wired. The cover 126, in assembly with the duct 156 is then assembled to the housing 30 and secured thereto with the fasteners 120. The cage 54, together with the closure number 56 disposed therein, may then be snapped fitted into engagement with the depending wall 99 of housing 30. The sound suppression layer 142 may, of course, be secured in its position in the chamber 140 with the bosses 144 and a suitable adhesive, if desired, prior to assembly of the cover 126 to housing 30.

Referring now to FIGS. 11 through 14, and FIG. 12 in particular, another embodiment of a powerhead housing assembly for a vacuum cleaning apparatus is illustrated and generally designated by the numeral 200. The powerhead 200 has a cylindrical lower housing member 202, FIG. 12, which includes a generally circular, planar support face 204 contiguous with a peripheral depending sidewall 206 which is contiguous with a circular flange 208 and delimited by a circular depending skirt 210. An annular groove 212 is defined in part by skirt 210 for receiving the upper peripheral edge 26 of tank 22, for example. Lower housing 202 also includes a reduced diameter, depending cylindrical wall 214 including means for receiving and supporting a float valve and filter support cage 54, for example, for supporting a float valve 56. A transverse wall 216 defines a working air inlet port 218 and a seat 220 for engagement by the float valve closure 56 to close off working air flow to a chamber 222. Lower housing 202 also includes opposed integral latch portions 203, FIG. 11, substantially like the latch portions 36 for the impeller housing 30.

Figure 13A:
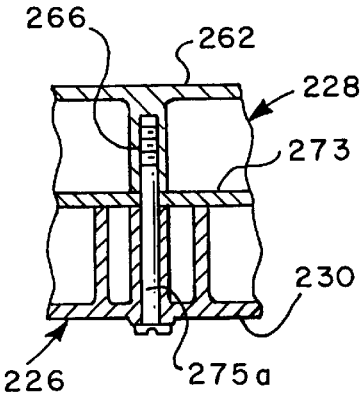
FIG. 13A is a detail section view taken along line 13A—13A of FIG. 13 showing a typical connection of housing members of the housing assembly.
Figure 13:
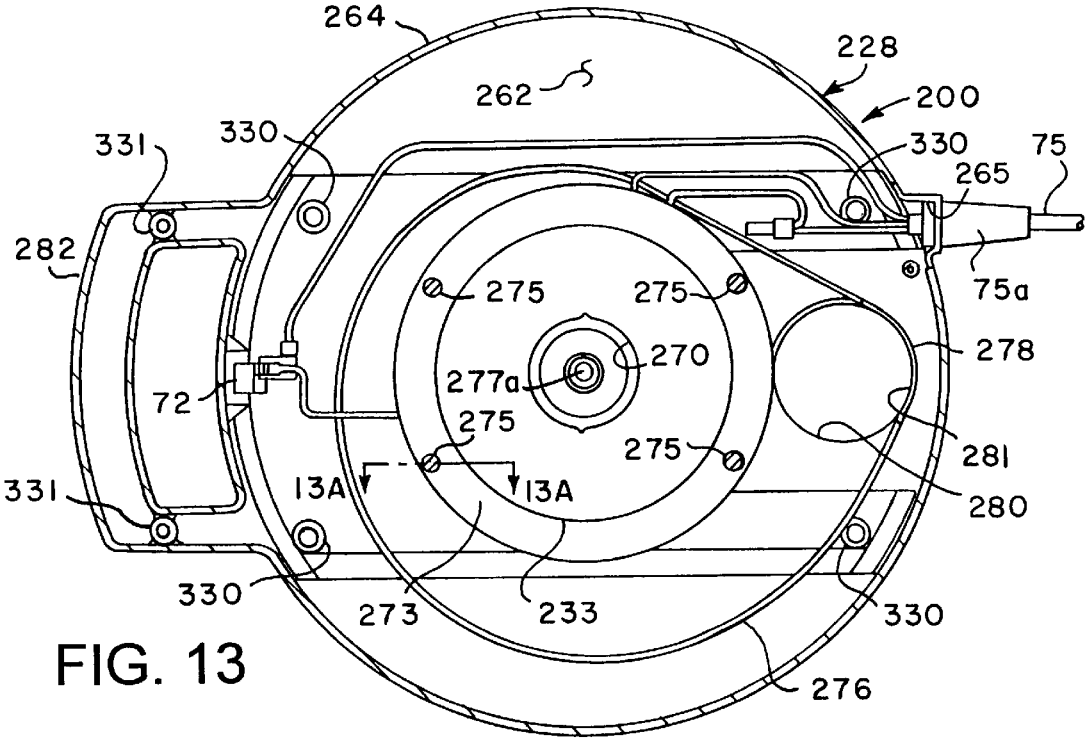
FIG. 13 is a bottom plan view of the top part of the impeller housing for the housing assembly shown in FIG. 12 and taken from the line 13—13 of FIG. 12.
Figure 12:
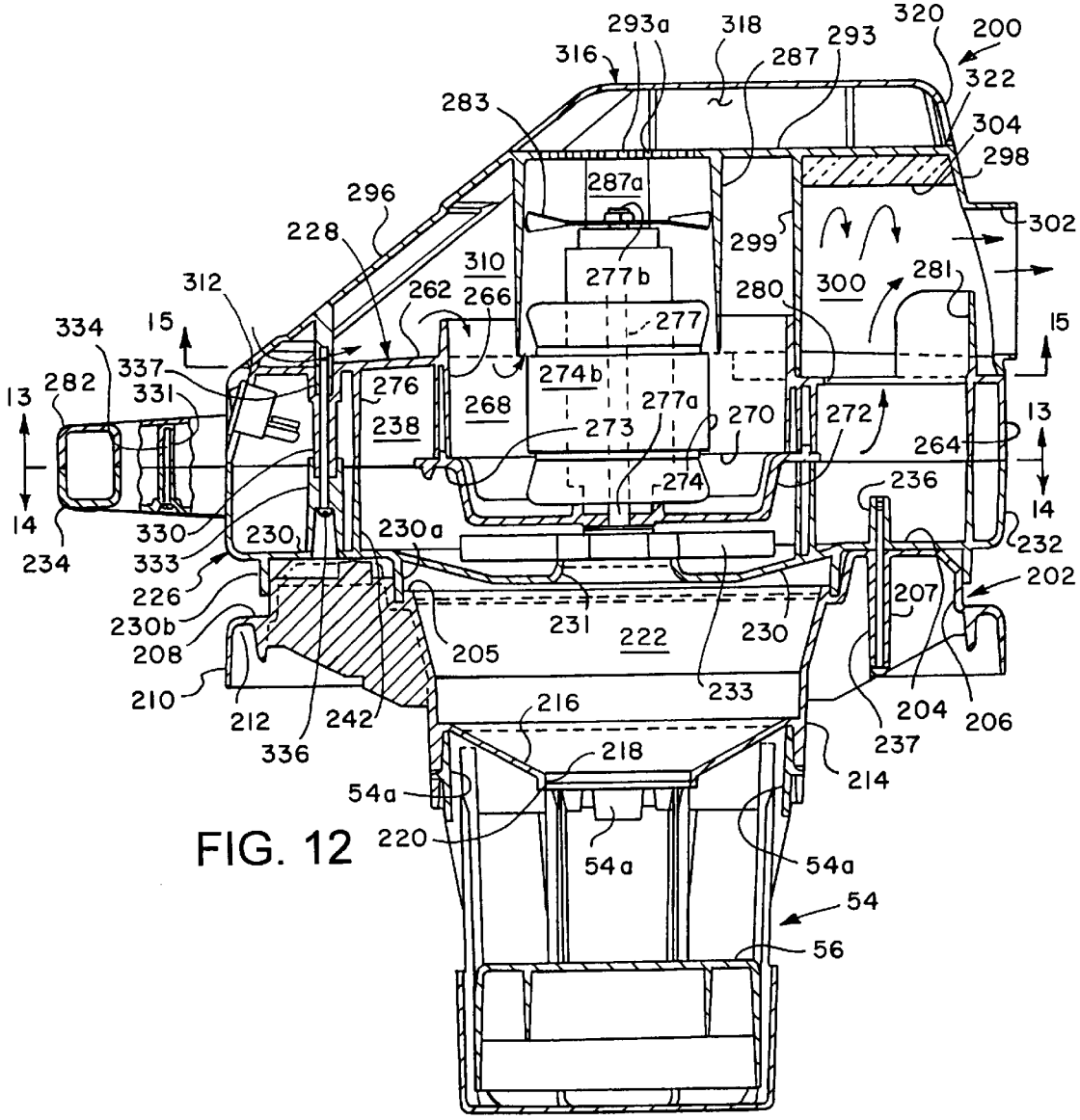
FIG. 12 is a section view taken generally along the line 12—12 of FIG. 11.
Figure 14:
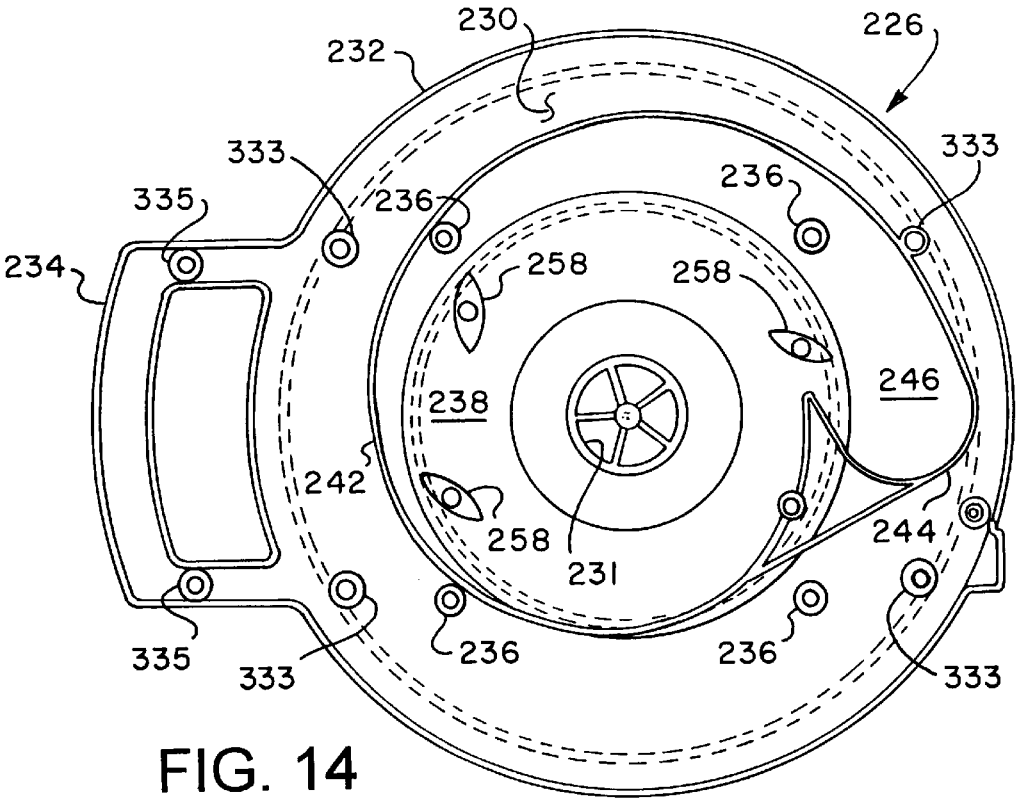
FIG. 14 is a top plan view of the bottom part of the impeller housing for the housing assembly shown in FIG. 12 and taken from the line 14—14 of FIG. 12.

The powerhead 200 also includes a working air impeller and motor support housing comprising two, opposed, shell-like impeller housing members, generally designated by numerals 226 and 228, respectively, FIGS. 12, 13 and 14. Housing member 226 comprises a transverse bottom wall 230 and an upstanding peripheral outer sidewall 232 joined thereto. Bottom wall 230 includes a centrally located working air inlet flow port 231, disposed adjacent the inlet to a working air centrifugal impeller 233, for conducting vacuum working air from chamber 222 to the impeller. A carrying handle portion 234 is integrally joined to the sidewall 232, as shown in FIG. 14 also. Four spaced apart fastener receiving bosses 236 are integrally formed with the bottom wall 230, FIG. 14, and have respective bores which open through the bottom wall for receiving threaded fasteners 237, one shown by way of example in FIG. 12, for securing housing member 202 to housing member 226. As shown in FIG. 12, concentric locating flanges 230*a* and 230*b*, which are integral with and depend from transverse wall 230, are configured to nest within a cooperating recess 205 formed in lower housing 202 and at least partially journal peripheral sidewall 206 of housing 202, respectively. Fasteners 237 also project through cooperating fastener receiving bosses 207 formed in lower housing 202, one shown in FIG. 12, and aligned with the bosses 236 when housing member 226 is engaged with housing 202.

A working air diffuser chamber 238 is formed by housing members 226 and 228, FIGS. 12 and 14, and is partially defined by a continuous somewhat spiral shaped intermediate wall 242 extending from transverse bottom wall 230 to a top edge of housing member 226 defined by a plane coincident with line 13—13, 14—14 in FIG. 12. Spiral wall 242 includes a circular segment portion 244, FIG. 14, defining part of a working air outlet chamber 246 for the impeller housing defined by the members 226 and 228.

Referring briefly to FIG. 14, housing member 226 is also, preferably, provided with plural, integral, spaced apart air flow directing and diffusing vanes 258 disposed within the diffuser chamber 238 and suitably secured to the transverse bottom wall 230 of housing member 226. The vanes 258 may be integrally formed with bottom wall 230.

Referring further to FIGS. 12 and 13, in particular, housing member 228 includes a generally transverse top wall 262 which is delimited by a depending peripheral sidewall 264 dimensioned to be co-extensive and contiguous with sidewall 232 of member 226 when members 226 and 228 are assembled together. Transverse wall 262 is intersected by a cylindrical inner wall 266 defining a motor cooling air flow chamber 268. Inner wall 266 terminates at a lower edge 270, FIG. 12, which is adapted to be engaged with a generally cylindrical base member 272 for an AC electric drive motor 274 similar to the motor 60. Wall 266 is provided with a circumferential locating groove 266*a* for base member 272 which is provided with a suitable ridge registrable in the groove.

Figure 16:
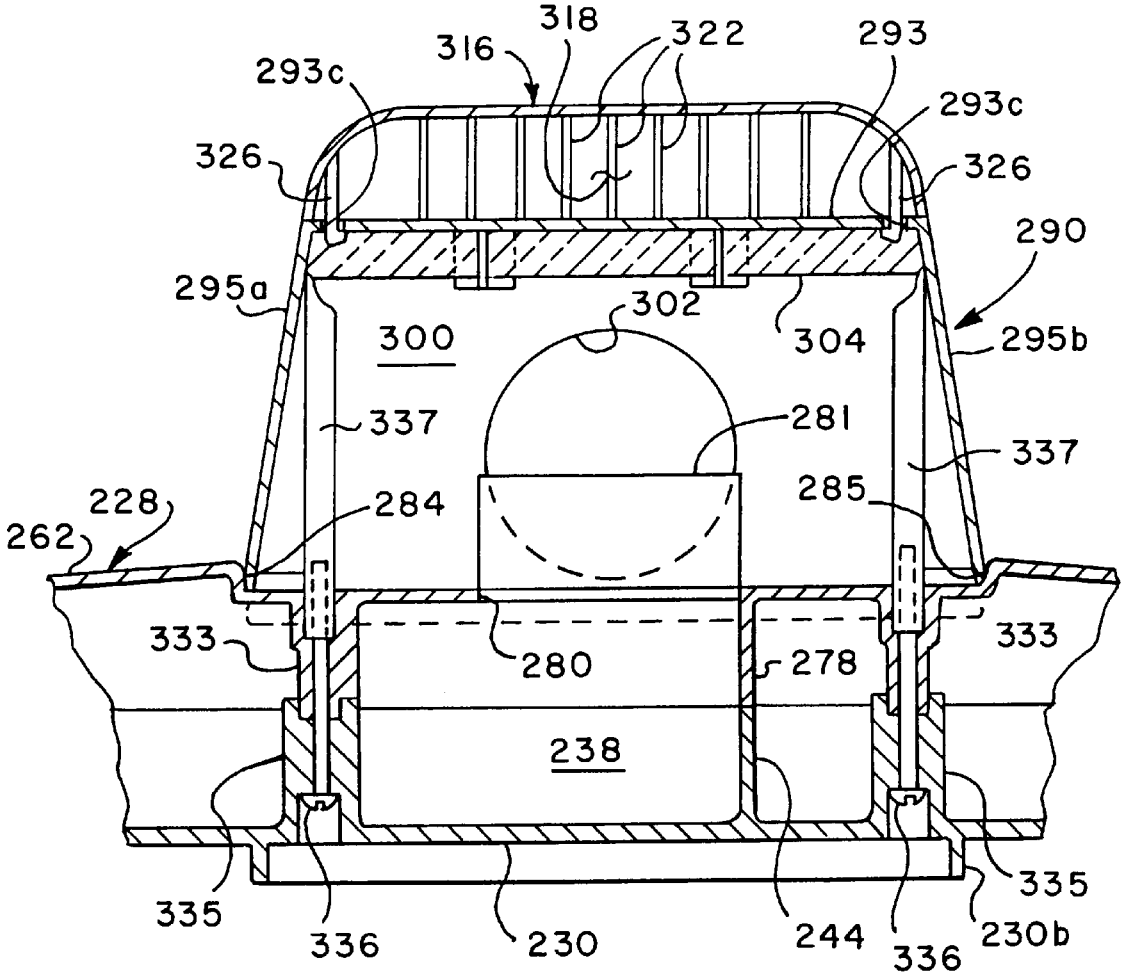
FIG. 16 is a section view taken generally along the line 16—16 of FIG. 11.

Housing member 228 is also provided with a continuous inner spiral wall 276 which depends from the transverse wall 262 and includes a circular segment portion 278. Wall 276, 278 has a configuration which is substantially a mirror image of wall 242, 244 so that when the housing members 226 and 228 are assembled to each other they define working air diffuser chamber 238. A working air discharge port 280 opens into chamber 238 through transverse wall 262. A lifting and carrying handle portion 282 projects from sidewall 264 opposite the port 280 and is configured to be co-operable with handle portion 234 to form a lifting and carrying handle for the powerhead 200. A circular segment upstanding baffle 281 projects upward from transverse top wall 262 at the working air discharge port 280 and is substantially coextensive with wall portion 278. As shown in FIG. 16, a recess, partially defined by opposed surfaces 284 and 285, is formed in the top wall 262 for receiving and locating a shroud member, generally designated by the numeral 290.

Referring again to FIGS. 12 and 13, the motor support base 272 includes a peripheral flange 273 which is registrable with the transverse edge 270 of inner wall 266 and is adapted to be secured to suitable spaced apart bosses, not shown, formed integral with the wall 266, by conventional mechanical fasteners inserted through bores 275, FIG. 13, in the flange. FIG. 13A illustrates, by way of example, the manner in which fasteners 275*a,* one shown, are preferably inserted through suitable bores in housing 226 from the bottom side of the housing, through the flange 273 and into the aforementioned bosses integral with wall 266. Motor 274 is suitably connected to the base member 272 in substantially the same manner as motor 60 is connected to its base 90. Motor 274 includes a rotor having a central shaft 277 connected at one 277*a* end to working air impeller 233 comprising a closed face centrifugal type impeller with an inlet opening 270, FIG. 13. The opposite 277*b* of shaft 277 supports an axial flow cooling air fan 283 which is shown disposed in a generally cylindrical duct 287 formed as an integral part of shroud 290.

Figure 15:
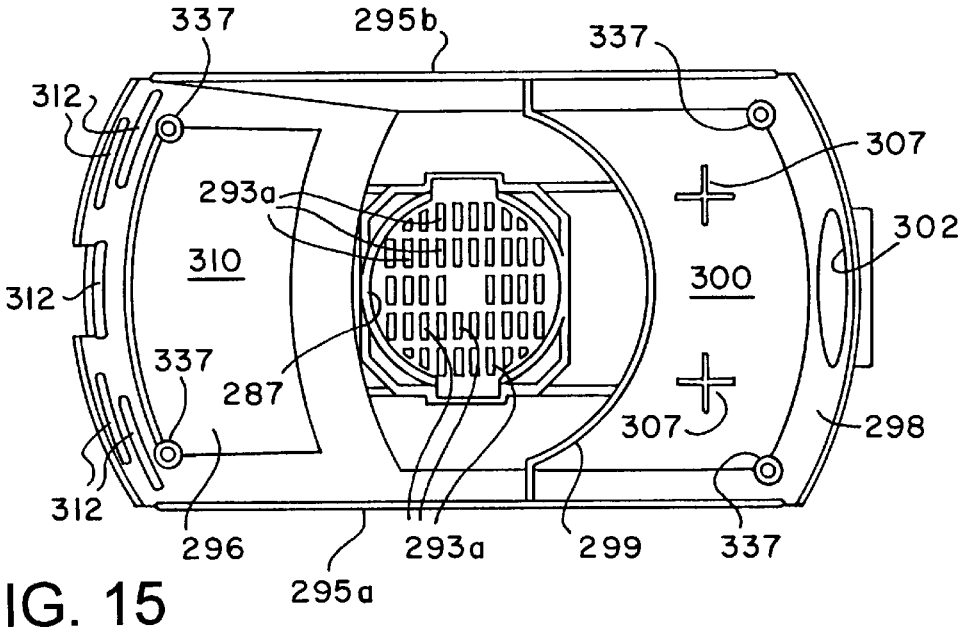
FIG. 15 is a bottom plan view of the motor shroud for the assembly shown in FIG. 12 and taken generally from the line 15—15 of FIG. 12.

Referring now to FIGS. 11, 12, 15 16, the shroud 290 is characterized by a transverse top wall 293, opposed longitudinal depending sidewalls 295*a* and 295*b* and opposed end walls 296 and 298. As shown in FIGS. 12 and 15, a transverse, substantially arcuate baffle 299 extends between sidewalls 295*a* and 295*b* and is spaced from end wall 298 to define a working air flow and sound suppression chamber 300. A working air discharge port 302 is formed in end wall 298 and opens into chamber 300. A layer 304 of sound suppressing foam material is suitably disposed within chamber 300 and secured to the inside surface of wall 293 by spaced apart cross shaped retention studs 307. Duct 287 is integrally joined to top wall 293 and depends therefrom spaced from the baffle 299. Cooling air inlet ports 312 are formed in sloping endwall 296 for admitting cooling air to a cooling air inlet flow chamber 310 which is in flow communication with chamber 268.

As shown in FIG. 12, duct 287 depends to a point generally adjacent the motor stator 274*b* but provides a gap therebetween to admit cooling air into the space 287*a* defined by the duct 287 for flow therethrough and through discharge ports 293*a* formed in top wall 293. A substantial amount of cooling air also flows between the rotor of motor 274 and the stator 274*b* from the lower region of chamber 268 upward through the motor into space 287*a*.

Figure 11:
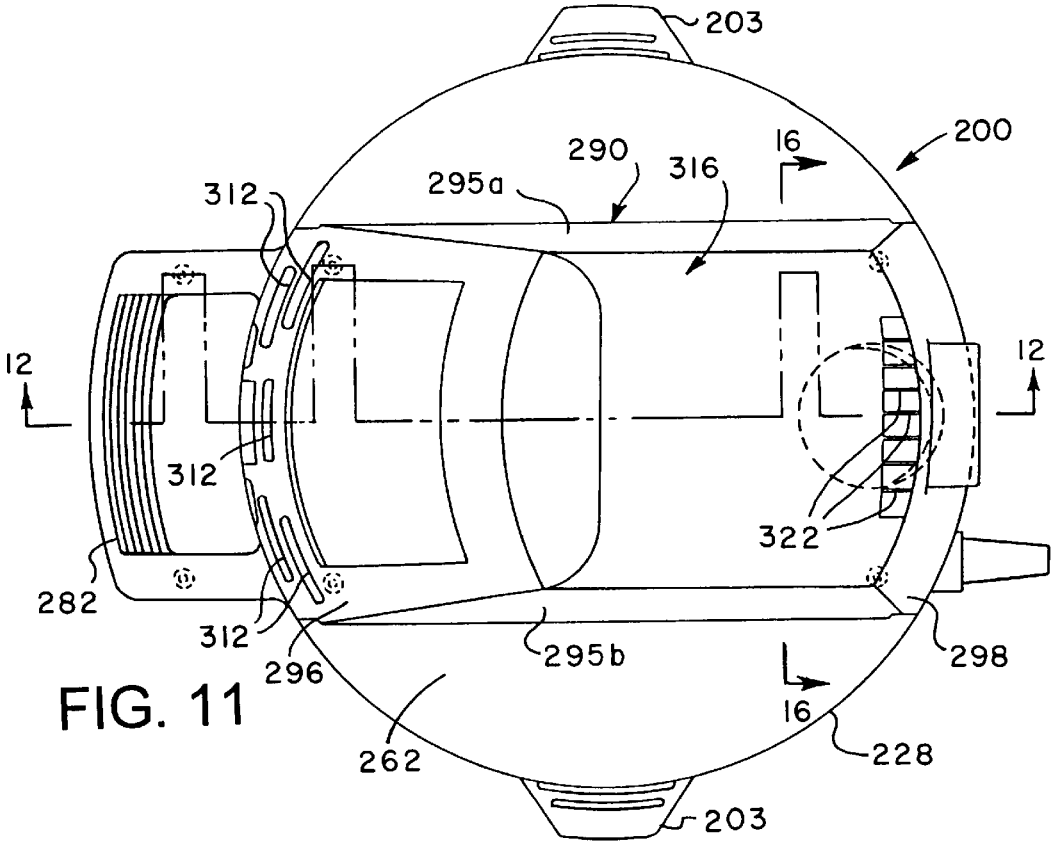
FIG. 11 is a top plan view of an alternate embodiment of a powerhead housing assembly in accordance with the invention.

Referring further to FIGS. 11, 12 and 16, a removable weather cap 316 is mountable on the shroud 290 over the top wall 293 and provides a flow chamber 318 therewithin. Cooling air discharge ports 320 are formed in a transverse end wall 322 of the cap 316 for discharging motor cooling air from the powerhead 200 at a point spaced from the cooling air inlet ports 312 and in the same direction of flow as working air exhaust flow from the shroud 290. The weather cap 316 includes spaced apart depending, elastically deflectable and integrally formed latch members 326, FIG. 16, which are operable to project through cooperating slots 293*c* in top wall 293 for engagement with the top wall, as shown. Accordingly, the weather cap 316 may be assembled to the shroud 290 by essentially pushing or snapping the latch members 326 into engagement with the shroud as illustrated and described.

An advantageous feature of the powerhead 200 resides in the means for securing the housing members 226 and 228 together and to the shroud 290. Referring briefly to FIG. 13, the housing member 228 includes four spaced-apart fastener receiving bosses 330 disposed within the confines of sidewall 264 and two additional bosses 331 disposed in the handle portion 282. In like manner, as shown in FIG. 14, the housing member 226 also includes spaced-apart fastener-receiving bosses 333 arranged in a pattern which coincides with the pattern of the bosses 330. Two additional bosses 335 are disposed in the handle portion 234. Bosses 333 and 335 are positioned to be aligned with the bosses 330 and 331, respectively, when the housing members 226 and 228 are assembled to each other. In fact, the bosses 333 are counter-bored to receive the distal ends of the bosses 330 as shown in FIGS. 12 and 16. Still further, the bosses 330 are each counter-bored to receive the distal ends of respective fastener receiving bosses 337 formed in the shroud 290, see FIGS. 15 and 16. Accordingly, elongated, conventional threaded fasteners 334 and 336, FIGS. 12 and 16, are operable to secure the housing members 226 and 228 to each other and to the shroud 290 and these fasteners are hidden from being tampered with except on deliberate disassembly of the powerhead 200. Moreover, the arrangement of the bosses 330, 333 and 337, including the counter-bored portions of bosses 330 and 333, facilitates easy assembly of the powerhead 200 in that these bosses assist in locating the housing members 226 and 228 relative to each other and relative to the shroud 290 during the assembly process.

Referring further, briefly, to FIGS. 12 and 13, the powerhead assembly 200 also includes a motor operating switch 72 mounted in a suitable recess in the housing member 228, as shown, and a recess 265 formed in the sidewall 264 for supporting a strain relief member 75*a* for power cord 75. The members 202, 226, 228, 290 and 316 may all be formed of a suitable injection moldable plastic material.

The powerhead 200 is, preferably, assembled by securing the motor 274 and base 272 in the working position shown in FIG. 12 by connecting the motor and base assembly to the housing member 228 with fasteners 275. The housing members 226, 228 and the shroud 290 are then assembled to each other with the fasteners 334 and 336. Prior to assembly of the shroud 290 to the member 228 the sound absorbing foam layer 304 may be secured in place within the chamber 300 in the position indicated in drawing FIGS. 12 and 16. Weather cap 316 may be assembled to the shroud 290 at any time. Lower housing 202 is then secured to the housing member 226 by cooperating fasteners 237, for example.

In operation, working air is drawn through inlet port 231 into impeller 233 and is discharged into the diffuser chamber 238 whereby the variable cross sectional area of this chamber allows deceleration of working air flow leaving the impeller and the flow is redirected through port 280 into chamber 300. Baffle 281 prevents direct discharge of working air exhaust flow through port 302 from chamber 238 and eliminates line of sight communication between the impeller 233 and the exterior of the powerhead 200. The volume of chamber 300 allows the working air flow to expand and decelerate prior to exiting the powerhead 200 through exhaust port 302. The layer 304 of sound suppression material also reduces certain audible noise emissions.

Motor cooling air flow to the motor 274 is drawn through ports 312 into chamber 310 and from chamber 310 into chamber 268 whereupon the direction of flow is substantially reversed as air flows over the motor 274 and within duct 287 to exit the duct through ports 293*a*. Cooling air flow is allowed to expand further and decelerate in chamber 318 and to exit the powerhead 200 through discharge ports 322 located directly over and facing in the same direction as the discharge port 302. Thanks to the baffle 299, motor cooling air flow and working air flow are separated and prevented from commingling prior to movement of cooling air over and through the motor 274.

Accordingly, the movement of working air and cooling air through the passages and chambers of the powerhead 200 is substantially unrestricted while, at the same time, noise generated by the impeller 233 and the cooling air fan 283, as well as from the turbulence of the air flow, is substantially reduced as the air is allowed to expand in the chambers 238, 300 and 318 and due to the fact that the direction of flow of working air, for example, leaving the impeller 233 changes at least twice as the air expands in chambers 238 and 300 prior to leaving the powerhead 200.

Although preferred embodiments of a powerhead housing assembly for a vacuum cleaning apparatus have been described in detail hereinabove, those skilled in the art will further appreciate that the invention may be modified in various ways without departing from the scope and spirit of the appended claims.

What is claimed is:

1. A powerhead housing assembly for a vacuum cleaning apparatus comprising:

an impeller housing including a generally transverse topwall, an upstanding, circumferential wall defining, at least in part, a cooling air flow chamber, a depending wall defining, a working air discharge chamber and means forming a working air discharge passage in said impeller housing for discharging working air therefrom;

a motor including a base member supported in said impeller housing, said motor including rotatable drive shaft means connected to a working air impeller at one end and a motor cooling air fan at an opposite end, said impeller being disposed in said housing adjacent said working air discharge chamber;

a cover member releasably connected to said impeller housing including a transverse top wall and a depending peripheral skirt defining, together with said impeller housing, a motor cooling air inlet passage, said cover member, defining a working air expansion chamber, said cooling air inlet passage being disposed spaced from said expansion chamber to minimize ingestion of working air exiting said housing assembly from entering said cooling air inlet passage; and a depending cylindrical duct part releasably connected to said cover member and disposed around at least a portion of said motor for directing cooling air flow impelled by said fan over said motor from said cooling air inlet passage to a cooling air discharge passage in said cover member.

2. The housing assembly set forth in claim 1 wherein:

said duct part includes a transverse wall portion defining a part of a cooling air discharge flow passage formed in said cover member and separating said cooling air inlet flow passage from said cooling air discharge flow passage.

3. The housing assembly set forth in claim 1 wherein:

said depending skirt of said cover member is spaced from said topwall of said impeller housing to define a gap for discharging working air from said expansion chamber and for admitting motor cooling air to said cooling air inlet passage, respectively.

4. The housing assembly set forth in claim 3 wherein:

said cover member includes a baffle formed therein and extending at least partially thereacross to prevent discharge of working air from said impeller housing into said cooling air inlet passage.

5. The housing assembly set forth in claim 4 including:

a baffle part mounted in said impeller housing and cooperable with said baffle to prevent discharge of working air into said cooling air inlet passage.

6. The housing assembly set forth in claim 5 wherein:

said baffle part is removably supported in said impeller housing and retained therein by said cover member.

7. The housing assembly set forth in claim 1 including:

a depending peripheral wall on said impeller housing including means for releasably supporting a float valve closure member on said impeller.

8. The housing assembly set forth in claim 1 wherein:

said impeller housing and said cover member are secured to each other by removable fasteners insertable through fastener receiving bosses formed on said transverse wall of said impeller housing, said fasteners being engageable with fastener receiving bosses on said cover member.

9. The housing assembly set forth in claim 1 wherein:

said top wall of said impeller housing is joined to a circumferential depending skirt defining, in part, a peripheral receiving groove for receiving the upper circumferential edge of a debris holding tank.

10. The housing assembly set forth in claim 1 wherein:

said impeller housing includes a radially extending transition wall part forming a chamber in communication with said working air discharge chamber and said working air discharge passage in said impeller housing.

11. The housing assembly set forth in claim 1 including:

a layer of sound suppression material supported on said cover member and disposed in said expansion chamber.

12. A powerhead housing assembly for a vacuum cleaning apparatus comprising:

a generally cylindrical impeller housing including a transverse top wall, a circumferential depending skirt secured to said top wall, and defining, in part, a peripheral receiving groove for the upper circumferential edge of a debris holding tank, a first generally cylindrical wall formed integral with said top wall and depending therefrom, a transverse flange formed integral with said first depending wall and adapted to support a motor assembly on said impeller housing, a second, generally cylindrical wall portion depending from said flange and defining, in part, a working air discharge flow chamber;

a motor disposed on said impeller housing and supported on said flange, said motor including drive shaft means connected at one end to a working air impeller and at an opposite end to a motor-cooling air fan;

a radially extending transition wall formed on said impeller housing and defining a working air discharge flow passage in communication with said working air discharge flow chamber and with a working air discharge passage disposed within said impeller housing;

a cover member for said housing assembly including a generally transverse top wall and a generally cylindrical depending sidewall, said cover member including plural spaced-apart fastener-receiving bosses engagable with cooperating bosses formed on said impeller housing for supporting said cover member on said impeller housing by releasable fastener means, said cover member including a transverse baffle thereon dividing said cover member into a working air expansion chamber and at least one cooling air inlet flow passage;

a removable duct part secured to said cover member and including a generally cylindrical depending duct wall adapted to be disposed around said motor and defining a cooling air flow passage for receiving cooling air to flow over said motor, said duct part including a portion cooperable with said cover member to define a cooling air discharge flow passage, said cover member being mounted on said impeller housing and defining a generally circumferential gap between said impeller housing and said depending sidewall of said cover member to provide a flowpath for cooling air flow into a chamber formed by said depending wall of said impeller housing and working air discharge from said expansion chamber.

13. The housing assembly set forth in claim 12 including:

a removable baffle part supported on said impeller housing and cooperable with said baffle on said cover member to prevent working air discharged from said expansion chamber from flowing into said cooling air flow chamber.

14. The housing assembly set forth in claim 13 wherein:

said baffle part includes a wall part defining a portion of said cooling air flow chamber.

15. A powerhead housing assembly for a vacuum cleaning apparatus comprising:

a working air impeller housing including a transverse bottom wall, a transverse top wall and a peripheral outer sidewall interposed between said bottom wall and said top wall, an intermediate wall extending between said bottom wall and said top wall and defining a somewhat spiral shaped working air discharge chamber for receiving a working air impeller and for conducting working air discharge flow from said impeller within said impeller housing, a working air discharge port in said top wall in communication with said discharge chamber, wall means depending from said top wall and defining a support surface for a motor assembly including a base member engageable with said wall means depending from said top wall for supporting an impeller drive motor in said impeller housing;

a drive motor including a base member disposed in said impeller housing and supported on said support surface, said drive motor including a rotatable shaft connected at one end to a working air impeller and, at an opposite end, to a motor cooling air fan;

a shroud supported on said top wall of said impeller housing and releasably connected to said impeller housing by fastener means, said shroud including a portion disposed over said working air discharge port and defining an expansion chamber for working air being discharged from said impeller housing, said shroud including a working air discharge port opening into said expansion chamber and a depending baffle wall separating said expansion chamber from a motor cooling air flow chamber, and said shroud further defining a motor cooling air inlet chamber and a cooling air discharge duct; and said wall means depending from said top wall further defines a cooling-air flow chamber in communication with said cooling air inlet chamber and with said cooling air discharge duct for conducting motor cooling air between said cooling air inlet chamber to said cooling air discharge duct.

16. The housing assembly set forth in claim 15 including:

a lower housing member including a transverse top wall and a peripheral depending skirt, said skirt defining at least in part, a peripheral groove for receiving a peripheral top edge of a debris collection tank;

means for supporting said impeller housing on said lower housing; and means for supporting a working air flow shutoff valve on said housing assembly.

17. The housing assembly set forth in claim 15 wherein:

said motor cooling air fan is disposed in said cooling air discharge duct.

18. The housing assembly set forth in claim 15 wherein:

said impeller housing includes a first housing member including said bottom wall and a part of said peripheral outer sidewall and said bottom wall includes a working air flow port formed therein for conducting working air to said impeller.

19. The housing assembly set forth in claim 18 wherein:

said impeller housing includes a second housing member including said top wall and a part of said peripheral outer sidewall cooperable with said part of said peripheral outer sidewall on said first housing member.

20. The housing assembly set forth in claim 19 wherein:

said first and second housing members include cooperable fastener-receiving bosses disposed thereon and cooperable with each other to position said first and second housing members with respect to each other and to receive fastener means for securing said housing members to each other.

21. The housing assembly set forth in claim 19 wherein:

said shroud includes spaced-apart fastener receiving bosses formed thereon and operable to engage said fastener receiving bosses on said second housing member and for receiving said fasteners whereby said first housing member, said second housing member and said shroud are secured to each other by a plurality of common fasteners.

22. The housing assembly set forth in claim 18 wherein:

said first housing member includes a circumferential depending flange engagable with a lower housing of said housing assembly, said lower housing including a transverse top wall engagable with said bottom wall of said first housing member and a peripheral depending skirt, said skirt defining at least in part a peripheral groove for receiving a peripheral top edge of a debris-collection tank.

23. A powerhead housing assembly for a vacuum cleaning apparatus comprising:

an impeller housing including a generally transverse topwall, an upstanding, circumferential wall defining, at least in part, a cooling air flow chamber, a depending wall defining, a working air discharge chamber and means forming a working air discharge passage in said impeller housing for discharging working air therefrom;

a motor including a base member supported in said impeller housing, said motor including rotatable drive shaft means connected to a working air impeller at one end and a motor cooling air fan at an opposite end, said impeller being disposed in said housing adjacent said working air discharge chamber;

a transverse flange formed in said impeller housing for supporting said base member of said motor, said base member and said impeller housing being secured to each other by removable fasteners; and a cover member releasably connected to said impeller housing including a transverse top wall and a depending peripheral skirt defining, together with said impeller housing, a motor cooling air inlet passage, said cover member, defining a working air expansion chamber, said cooling air inlet passage being disposed spaced from said expansion chamber to minimize ingestion of working air exiting said housing assembly from entering said cooling air inlet passage.

24. A powerhead housing assembly for a vacuum cleaning apparatus comprising:

a working air impeller housing including a transverse bottom wall, a transverse top wall and a peripheral outer sidewall interposed between said bottom wall and said top wall, an intermediate wall extending between said bottom wall and said top wall and defining a somewhat spiral shaped working air discharge chamber for receiving a working air impeller and for conducting working air discharge flow from said impeller within said impeller housing, a working air discharge port in said top wall in communication with said discharge chamber, wall means depending from said top wall and defining a support surface for a motor assembly including a base member engageable with said wall means for supporting an impeller drive motor in said impeller housing;

a drive motor including a base member disposed in said impeller housing and supported on said support surface, said drive motor including a rotatable shaft connected at one end to a working air impeller and, at an opposite end, to a motor cooling air fan;

a shroud supported on said top wall of said impeller housing and releasably connected to said impeller housing by fastener means, said shroud including a portion disposed over said working air discharge port and defining an expansion chamber for working air being discharged from said impeller housing, said shroud including a working air discharge port opening into said expansion chamber and a depending baffle wall separating said expansion chamber from a motor cooling air flow chamber, and said shroud further defining a motor cooling air inlet chamber and a cooling air discharge duct; and a weather cap supported on said shroud and forming a final cooling air discharge flow chamber, said cap including cooling air discharge port means for the discharge of motor cooling air from said housing assembly.

25. The housing assembly set forth in claim 24 wherein:

said cap includes spaced-apart deflectable latch members operable to engage said shroud for securing said cap to said shroud.

26. The housing assembly set forth in claim 24 wherein:

said shroud includes an end wall defining at least one motor-cooling air inlet port opening into said cooling air inlet chamber, said inlet port being disposed at one end of said shroud and opposite said working air discharge port in said shroud.

27. A powerhead housing assembly for a vacuum cleaning apparatus comprising:

a working air impeller housing including a transverse bottom wall, a transverse top wall and a peripheral outer sidewall interposed between said bottom wall and said top wall, an intermediate wall extending between said bottom wall and said top wall and defining a somewhat spiral shaped working air discharge chamber for receiving a working air impeller and for conducting working air discharge flow from said impeller within said impeller housing, a working air discharge port in said top wall in communication with said discharge chamber, wall means depending from said top wall and defining a support surface for a motor assembly including a base member engageable with said wall means for supporting an impeller drive motor in said impeller housing;

a drive motor including a base member disposed in said impeller housing and supported on said support surface, said drive motor including a rotatable shaft connected at one end to a working air impeller and, at an opposite end, to a motor cooling air fan;

a shroud supported on said top wall of said impeller housing and releasably connected to said impeller housing by fastener means, said shroud including a portion disposed over said working air discharge port and defining an expansion chamber for working air being discharged from said impeller housing, said shroud including a working air discharge port opening into said expansion chamber and a depending baffle wall separating said expansion chamber from a motor cooling air flow chamber, and said shroud further defining a motor cooling air inlet chamber and a cooling air discharge duct;

said impeller housing includes a first housing member including said bottom wall and a part of said peripheral outer sidewall and said bottom wall includes a working air flow port formed therein for conducting working air to said impeller, and a second housing member including said top wall and a part of said peripheral outer sidewall cooperable with said part of said peripheral outer sidewall on said first housing member, said first and second housing members include cooperable fastener-receiving bosses disposed thereon and cooperable with each other to position said first and second housing members with respect to each other and to receive fastener means for securing said housing members to each other, and said first housing member and said second housing member include handle portions, respectively, cooperable with each other to form a lifting and carrying handle for said housing assembly.

* * * * *